US007438280B2

(12) United States Patent
Doud et al.

(10) Patent No.: US 7,438,280 B2
(45) Date of Patent: Oct. 21, 2008

(54) HIGH LOAD FLANGE PROFILE FOR A WIRELINE DRUM

(75) Inventors: Brian Doud, Houston, TX (US); James Benner, Missouri City, TX (US); Ravicharan Mydur, Missouri City, TX (US); Jean Louis Pessin, Houston, TX (US); Jeff Kamps, Katy, TX (US); Jose R. Jimenez, III, Sugar Land, TX (US); Emma Ford, Abbeville (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/617,341

(22) Filed: Dec. 28, 2006

(65) Prior Publication Data

US 2008/0156928 A1 Jul. 3, 2008

(51) Int. Cl.
*B21F 9/00* (2006.01)

(52) U.S. Cl. ..... 254/214; 254/278; 242/407; 242/614.1

(58) Field of Classification Search ..... 242/407, 242/614, 614.1, 118.4, 602, 603, 322; 254/214, 254/215, 278, 371, 372
See application file for complete search history.

(56) References Cited

U.S. PATENT DOCUMENTS 1,404,934 A * 1/1922 Cunningham ..... 242/610.3
1,822,422 A 9/1931 Richardson
1,984,604 A 12/1934 Stahl
2,420,050 A 5/1947 Maude
2,892,598 A 6/1959 Dudley
3,266,748 A 8/1966 Le Bus, Sr.
3,391,443 A 7/1968 Le Bus, Sr.
3,610,549 A * 10/1971 Wennerstrom et al. ..... 242/176
3,717,315 A * 2/1973 Kovaleski ..... 242/609.1
3,850,380 A * 11/1974 Kranefeld ..... 254/271
4,269,371 A * 5/1981 Kovaleski ..... 242/118.6
4,602,751 A * 7/1986 Vogel ..... 242/118.4
5,330,127 A * 7/1994 Hafner ..... 242/118.4
5,474,254 A * 12/1995 Faulkner ..... 242/614
6,801,113 B2 * 10/2004 Nakazaki et al. ..... 336/198
6,916,045 B2 * 7/2005 Clancy et al. ..... 280/805
6,980,709 B2 * 12/2005 Carlson et al. ..... 385/12
2003/0085391 A1 5/2003 Noske

FOREIGN PATENT DOCUMENTS

DE 10224418 A1 1/2004
JP 05043193 A 2/1993
RU 2205148 C2 5/2003

* cited by examiner

*Primary Examiner*—Emmanuel M Marcelo
(74) *Attorney, Agent, or Firm*—Michael Flynn; David Cate; Jaime Castano

(57) ABSTRACT

A wireline cable winch drum is provided that includes a core having a longitudinal axis; a pair of flanges spaced apart and extending radially outwardly from the core; and a wireline cable wrapped around the core in the space between the flanges. In one embodiment, at least one of the flanges includes an inner surface that contacts the wireline cable and forms an angle with respect to the longitudinal axis of the core.

22 Claims, 7 Drawing Sheets

HIGH LOAD FLANGE PROFILE FOR A WIRELINE DRUM

FIELD OF THE INVENTION

The present invention relates generally to a wireline cable winch drum having an improved geometry for better absorbing forces exerted thereon by the wireline cable, and/or to a wireline cable winch drum equipped with sensors to monitor various physical properties of the drum.

BACKGROUND

A wireline cable winch drum traditionally consists of a cylindrical core and two spaced apart flanges disposed at opposite ends of the core and extending radially outwardly in a direction perpendicular to the axis of the core. The winch drum functions to store wireline cable on the core in the space between the flanges, and also to convert a rotational motion of the drum into a translational motion of the wireline cable by rotating the drum about its central axis.

FIG. 1 is a partial view of one quadrant a typical winch drum 10, showing one of the flanges 12, the core 14, and a wireline cable 16 wrapped around the core 14. As shown, when the cable 16 is wound around or spooled onto the drum 10, it forms multiple layers stacked upon each other. For example, when the cable 16 is spooled onto the drum 10, a first layer 1 is formed along the outside diameter of the core 14 until the entire width of the core 14 is occupied, a second layer 2 is then formed along the outer surface of the first layer 1, and each successive layer (3-6) is formed along the outer surface of the previously formed layer.

Each layer of wound cable 16 places two primary forces on the winch drum 10: forces directed radially inwardly on the core 14 (for example forces $F_{R1}$-$F_{R3}$ in the depiction of FIG. 1), and forces directed axially outwardly on the flanges 12 (for example forces $F_{A1}$-$F_{A5}$ in the depiction of FIG. 1), with each layer increasing the cumulative forces exerted on the drum core 14 and the flanges 12.

The forces $F_{A1}$-$F_{A5}$ on the drum flanges 12 are primarily in the axial direction due to the fact that the flanges 12 are perpendicular to the longitudinal axis of the core 14. Although, the radial forces $F_{R1}$-$F_{R3}$ on the core 14 are damaging, it is typically these axial forces $F_{A1}$-$F_{A5}$ on the flanges 12 which cause the drum 10 to fail, and in particular it is the junction 18 between the core 14 and each flange 12 where the drum 10 is most likely to fail. This is due primarily to the large bending moment M that is created at the junction 18 by the axial forces $F_{A1}$-$F_{A5}$.

In addition, each successive layer increases the cumulative moment M at the junction 18 and each successive layer produces a moment at the junction 18 that is generally larger than the moment created by the previous layer due to the increased distance (or moment arm) of each successive layer from the junction 18. For example, the bending moment at the junction 18 from the first, third and fifth layers of cable 16 is equal to $F_{A1}*d_1$, $F_{A3}*d_3$, and $F_{A5}*d_5$, respectively. As such, the moment at the junction 18 created by each layer is directly proportional to the distance of that layer from the junction 18. This is of particular concern for wireline cable winch drums 10, since the cable 16 wound thereon can be 30,000 feet long or more. Thus, a large number of layers are required to spool all 30,000 feet of cable 16 onto the drum 10, sometimes as many as thirty layers or more. As such, the distance from the outer most layer of cable 16 to the junction 18 can be relatively large. Resulting in a correspondingly large bending moment on the junction 18, which can ultimately lead to the failure of the drum 10.

Accordingly, a need exists for a cable winch drum better suited for absorbing the forces exerted thereon for wireline cable applications and/or a system for monitoring physical properties of the winch drum.

SUMMARY

In one embodiment, the present invention is a wireline cable winch drum that includes a core having a longitudinal axis; a pair of flanges spaced apart and extending radially outwardly from the core; and a wireline cable wrapped around the core in the space between the flanges. In one embodiment, at least one of the flanges includes an inner surface that contacts the wireline cable and forms an angle with respect to the longitudinal axis of the core.

In another embodiment, the present invention is a wireline cable winch drum that includes a core having a longitudinal axis; a pair of flanges spaced apart and extending radially outwardly from the core; a wireline cable wrapped around the core in the space between the flanges; and at least one moving device connected to at least one of the flange to move its attached flange in a direction parallel to the longitudinal axis of the core.

In yet another embodiment, the present invention is a wireline cable winch drum that includes a core having a longitudinal axis; a pair of flanges spaced apart and extending radially outwardly from the core; a wireline cable wrapped around the core in the space between the flanges; and at least one sensor attached to the drum for measuring a physical property of the drum.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

As shown in FIGS. 2-14, embodiments of the present invention are directed to a wireline cable winch drum having flanges with inner surfaces that are angled with respect to the longitudinal axis of the drum core to better absorb the forces exerted on the flanges by the wireline cable. In other embodiments, the flanges are moveable to decrease the stresses between the flanges and the wireline cable. In still further embodiments, the cable drums are equipped with sensors to monitor various physical properties of the drum.

Figure 2:
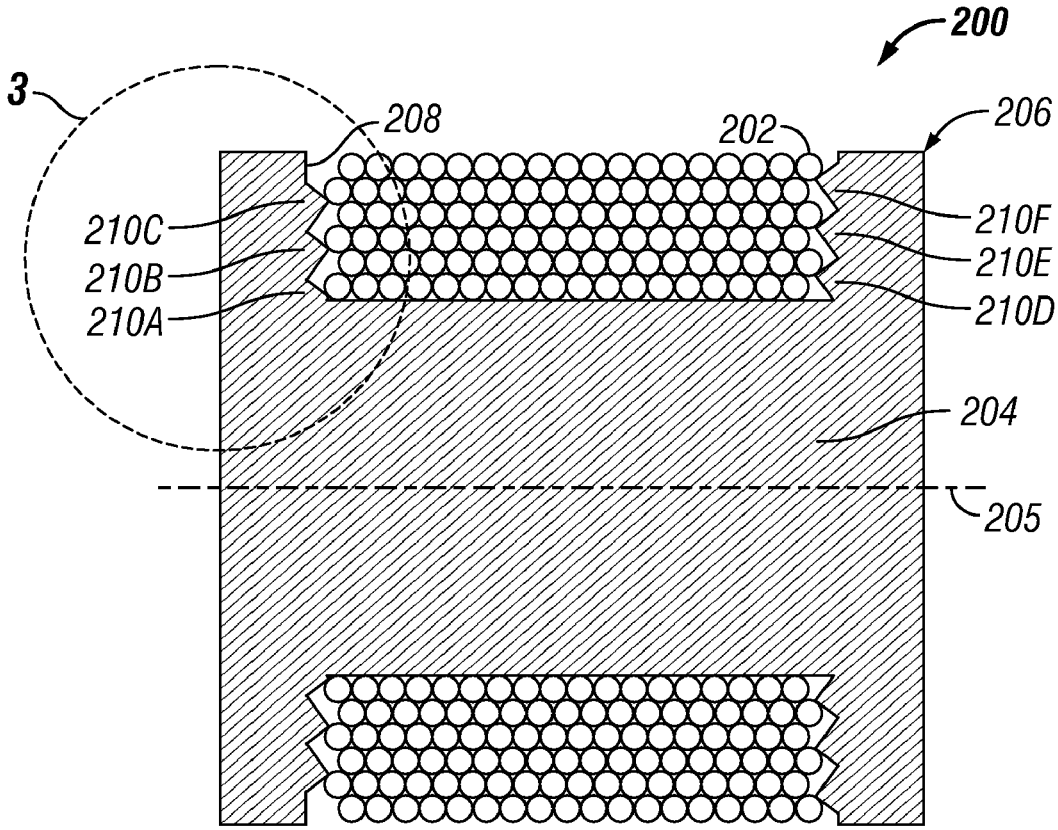
FIG. 2 is a cross sectional view of a winch drum according to one embodiment of the present invention.
Figure 3:
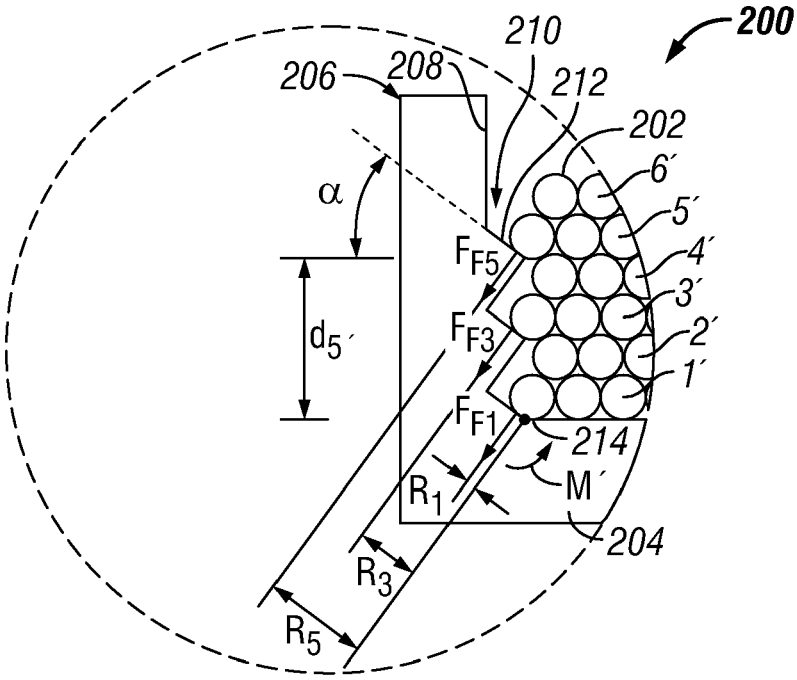
FIG. 3 is an enlarged view of a portion of the winch drum of FIG. 2 taken from detail 3-3 in FIG. 2.

FIGS. 2 and 3 show a winch drum 200 according to one embodiment of the present invention for holding a wireline cable 202. As shown, the drum 200 includes a core 204 and two spaced apart flanges 206 disposed at opposite ends of the core 204 and extending radially outwardly in a direction perpendicular to a longitudinal axis 205 of the core 204. The cable 202 is wrapped around the outer diameter of the core 204 in the area between the flanges 206. When the cable 202 is spooled onto the drum 200, it forms multiple layers stacked upon each other, with each layer having a substantially constant radius across the width of the core 204. For example in the depicted embodiment, six layers are shown (layers 1-6.) However, any appropriate number of layers may be formed depending on the diameter of the cable 202, the overall length of the cable 202 to be stored on the drum and the width of the core 204. For example, in one embodiment the cable 202 may form thirty layers or more.

As shown, after a first layer 1' has been formed, a second layer 2' naturally wraps around the outer surface of the first layer 1' and lays in grooves created by adjacent cross sections of the cable 202 along the first layer 1'. Each successive layer, (layers 3'-6') similarly naturally wraps around the outer surface of the previously formed layer and lays in grooves created by the previously formed or underlying layer.

In the depicted embodiment, an inner surface 208 of each flange 206 includes a plurality of angled protrusions 210 (note that each protrusion 210 is generically referenced by reference numeral 210 unless a specific location on a corresponding one of the flanges 206 is noted, in such a case reference numeral 210 is followed by a letter.) Each protrusion 210 includes a contact surface 212 which contacts the cable 202 at an end of a corresponding one of the cable layers.

For example, in the depicted embodiment, a first protrusion 210A is in contact with the cable 202 at an end of the first cable layer 1', a second protrusion 210B is in contact with the cable 202 at an end of the third cable layer 3', and a third protrusion 210C is in contact with the cable 202 at an end of the fifth cable layer 5'. Similarly, the opposite flange 206 includes a first protrusion 210D that is in contact with the cable 202 at an end of the second cable layer 2', a second protrusion 210E that is in contact with the cable 202 at an end of the fourth cable layer 4', and a third protrusion 210F that is in contact with the cable 202 at an end of the sixth cable layer 6'. As such in this embodiment, each portion of the cable 202 that contacts the flanges 206 does so along the contact surface 212 of a corresponding one of the protrusions 210.

Figure 1:
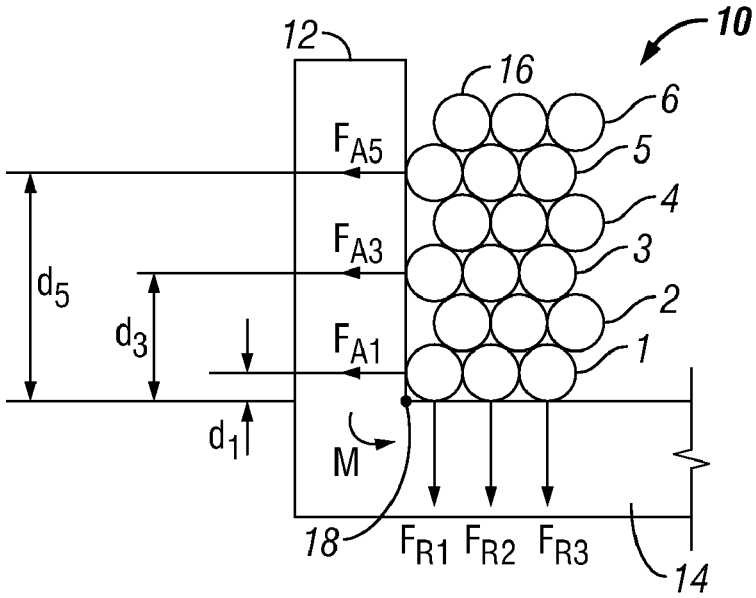
FIG. 1 (Prior Art)
FIG. 1 is a cross sectional view of a portion of a quadrant of a winch drum according to the prior art.

With such a configuration, a bending moment M' created about a junction 214 between each flange 206 and the core 204 is substantially reduced when compared to the bending moment M created at the junction 18 of each flange 12 and the core 14 for the configuration of the prior art drum 10 shown in FIG. 1. That is, the cable 202 in the embodiment of FIGS. 2 and 3 does not apply a primarily axial force on the flanges 206 as occurs in the prior art drum 10, rather the cable 202 applies a force on the flange 206 ($F_{F1}$, $F_{F3}$, $F_{F5}$ . . . ) along a line perpendicular to the contact surface 212 at the contact point between the cable 202 and the corresponding protrusion 210 that is contacts.

As shown, the resulting moment arm ($R_1$, $R_3$, $R_5$ . . . ) created from such contact is substantially smaller than the vertical distance between the core/flange junction 214 and the point of contact between the cable 202 and the flange 206 (i.e. what would be the moment arm if the force exerted on the flange 206 from the cable 202 where primarily in the axial direction.)

For example, the moment arm $R_5$, created by the force exerted on the flange 206 from the fifth layer 5' of the cable 202 is almost ½ as small as the vertical distance between core/flange junction 214 and the point of contact between the fifth layer 5' of the cable 202 and the flange 206. This difference becomes even more dramatic for cable layers that are successively farther from the outer diameter of the core 204. As a result, the cumulative bending moment M' at the junction 18 of each flange 12 and the core 14 is substantially reduced, and the life of the drum 200 is likely increased. Note that the smaller the angle $\alpha$ (between the protrusion contact surface 212 and the longitudinal axis 205 of the core 204, the smaller the moment arm created by the force exerted on the flanges 206 by the cable 202. However, for very small contact surface angles $\alpha$ it becomes difficult to spool the cable 202 onto the drum 200 in a manner that allows each layer to properly contact the contact surfaces 212 of the protrusions 210. This is because during spooling onto the drum 200, the protrusions farther from the core 204 get in the way of the protrusions that are closer to the core 204. As such, in one embodiment the contact surface angle $\alpha$ (is in the range of approximately 10° to approximately 90°, and preferably in the range of approximately 30° to approximately 60° However, in other embodiments the contact surface angle may be in the range of approximately 0° to approximately 90°.

Note as mentioned above, FIGS. 2 and 3 show the cable 202 as forming six layers on the core 204. However, with extreme lengths of the cable 202, for example for cable lengths of 30,000 feet or more, the cable 202 can form thirty or more layers on the core 204. As can be seen in FIG. 3, the contribution of the first few cable layers to the cumulative bending moment M' at the junction 18 of each flange 12 and the core 14 is relatively small. As such, in one embodiment the inner surfaces of the flanges in the areas adjacent to the first few cable layers do not include the above described protrusions 210. However, the remainder of the inner surfaces of the flanges do. This may lower the manufacturing cost of the drum without substantially effecting the bending moment at the junction of each flange and the core.

In one embodiment, the drum 200 of FIGS. 2 and 3 may be of a unitary construction made by a casting process. However, the drum 200 may be made by any other appropriate manufacturing process and the protrusions 210 may be attached to the flanges 206 by any appropriate manner.

Figure 4:
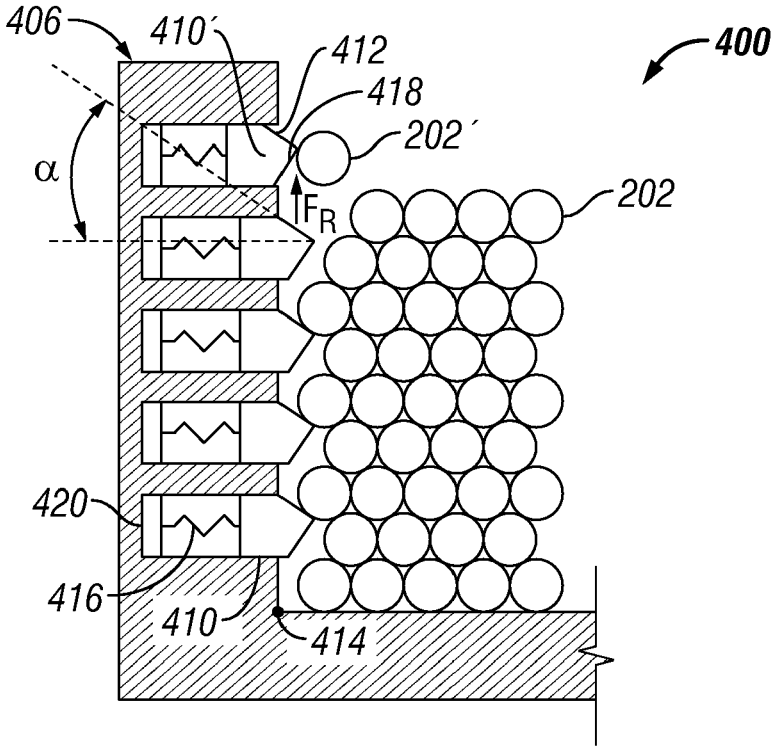
FIG. 4 is a cross sectional view of a portion of a quadrant of a winch drum according to another embodiment of the present invention.

The descriptions and variations described above with respect to the winch drum 200 shown in FIGS. 2 and 3 apply equally well to the winch drum 400 shown in FIG. 4, except that the winch drum 400 shown in FIG. 4 includes protrusions 410 on the inner surface 408 of its flanges 406 which are movable. Specifically, each protrusion 410 attached to and biased by a biasing member 416, such as a compression spring, in an axial direction away from its corresponding flange 406 and into contact with the cable 202.

For this embodiment, the spring constant of each biasing member 416 and the angle $\alpha$ that the contact surface 412 of each protrusion 410 makes with the longitudinal axis of the drum core 404 are chosen to enable the protrusions 410 to extend from the inner surface of the flanges 406 when the cable 202 is spooled onto the drum 400 to allow contact to be made between the contact surfaces 412 of the protrusions 410 and the cable 202 to reduce the bending moment on the junctions 414 between the flanges 406 and the drum core 404 as described above with respect to FIGS. 2 and 3. At the same time the spring constant and the contact surface angle $\alpha$ (are chosen to allow the protrusions 410 to retract axially within the flanges 206 when the cable 202 exerts an upward radial force FR on an under surface 418 of each protrusion 410 as the cable 202 is spooled off of the drum 400.

This is shown pictorially in FIG. 4. As shown, as the cable 202 is spooled off of the drum 400, a portion 202' of the cable 202 moves vertically upward, contacting a corresponding one of the protrusions 410' in the process causing the protrusion 410' to compress the biasing member 416 that is attached thereto to retract the protrusion 410' axially with respect to the flange 406. In all other respects, the protrusions 410 on the drum 400 as shown in FIG. 4 include the same characteristics as the protrusions 210 on the drum 200 as shown in FIG. 2. In one embodiment each biasing member 416 terminates in a sensor 420 such as a load cell for indirectly measuring the tension in the cable 202.

Figure 5:
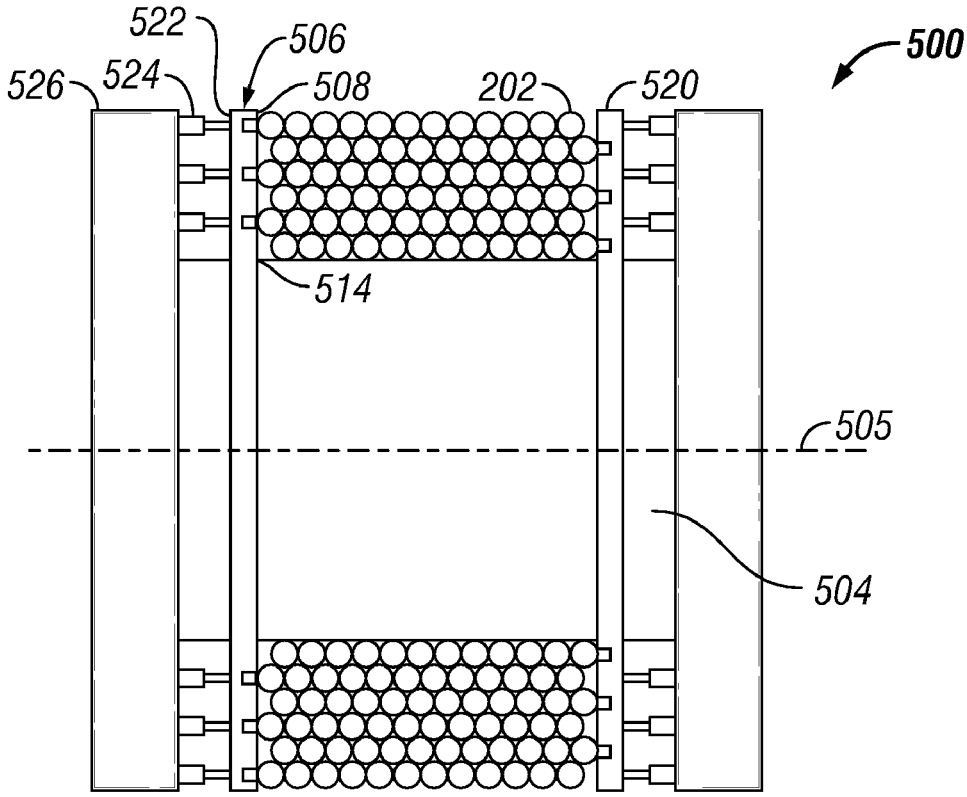
FIG. 5 is a schematic representation of a cross sectional view of a winch drum according to an alternative embodiment of the present invention.
Figure 6:
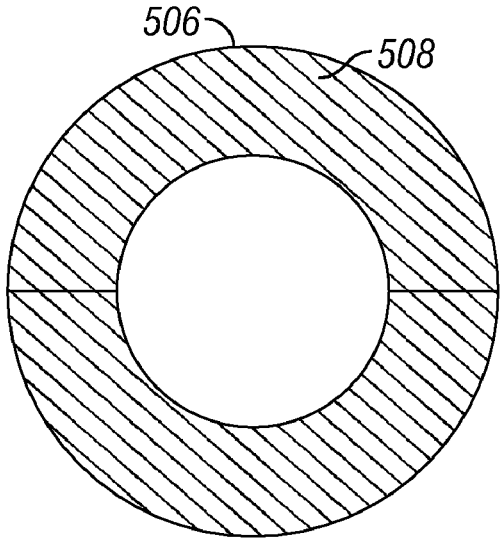
FIG. 6 is a side cross sectional view of a flange used on the winch drum of FIG. 5.

In the embodiment of FIGS. 5 and 6, the drum 500 includes flanges 506 that are moveable along the longitudinal axis 505 of the drum core 504. As shown in FIG. 6, each flange 506 may be composed of a pair of substantially semi-circular rings having a cutout for receiving the core 504. The inner surfaces 508 of the flanges 506 make contact the ends of each layer of the cable 202. As such, in order to reduce the bending moments at the junctions 514 between the flange 506 and the core 504, the inner surfaces 508 of the flanges 506 may have any of the configurations of the inner surfaces in the embodiments of FIGS. 3, 4, or 7, described below. Alternatively, the inner surfaces 508 of the flanges 506 may be perpendicular to the longitudinal axis 505 of the core 504.

Attached to the outer surfaces 522 of the flanges 506 are a series of moving devices 524, which move the flanges 506 laterally along the longitudinal axis 505 of the core 504. The moving devices 524 may be in the form of hydraulic cylinders, springs, or screw fasteners among other appropriate devices. As shown, the moving devices are disposed between the flanges 506 and an outer set of flanges 526. This configuration may be fabricated as a new drum or the movable flanges 506 may be retrofitted to an existing drum.

The movable flanges 506 may include a series of sensors 520, such as load cells, at the interface of each cable layer with the movable flanges 506 to monitor the stress caused by the contact therebetween. The measured stress could then be used to determine a distance to move the movable flanges 506 to achieve a desired stress reduction or alternatively to achieve an acceptable level of stress between the movable flanges 506 and the cable 202. This would decrease the mutual forces between the cable 202 and the flanges 506, thereby reducing the internal stresses generated within the drum 500 and the cable 202. In addition, the sensors 520 could also be used to indirectly measure the tension in the cable 202. Note that although the drum 500 shown in FIGS. 5 and 6 includes two movable flanges 506 in one embodiment the drum may include a single movable flange 506.

Alternatively to that discussed above, the movable flanges 506 may be moved by a predetermined distance irrespective of the measured stress by the sensors 520. In fact, the movable flanges 506 may be moved by a predetermined distance even in an embodiment where sensors 520 are not present.

Figure 7:
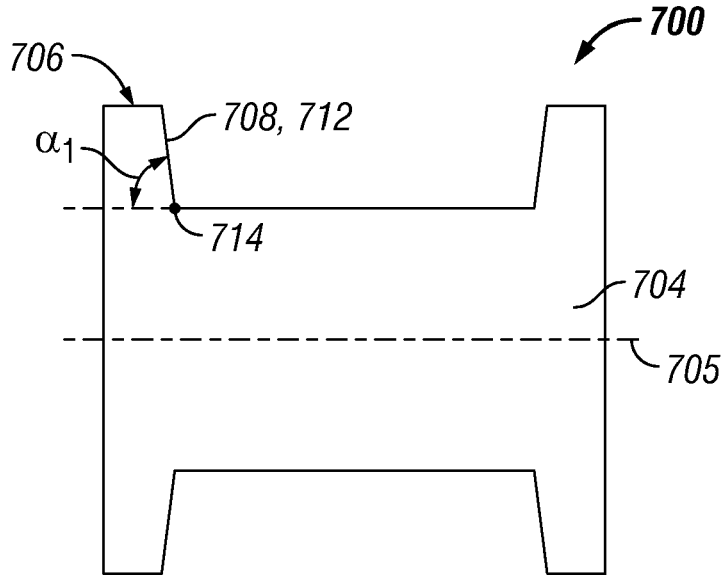
FIG. 7 is a cross sectional view of a winch drum according to yet an alternative embodiment of the present invention.
Figure 8:
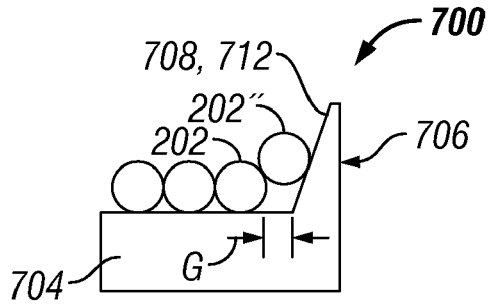
FIG. 8 is an enlarged view of a portion of the winch drum of FIG. 7.

FIG. 7 shows a drum 700 which is similar to the drum 200 shown in FIGS. 2 and 3, except whereas the inner surfaces 208 of the flanges 206 of the drum 200 shown in FIGS. 2 and 3 have a series of protrusions 210 with contact surfaces 212 that are angled with respect to the longitudinal axis 205 of the drum core 204, the inner surfaces 708 on the flanges 706 of the drum 700 shown in FIG. 7 each form one continuous contact surface 712. These contact surfaces 712 each which form an angle $\alpha_1$ with respect to the longitudinal axis 705 of the drum core 704. As with the drum 200 of FIGS. 2 and 3, the angled contact surface 712 in the drum of FIG. 7 reduces the bending moments at the junctions 714 of the flanges 706 and the core 704.

Figure 9:
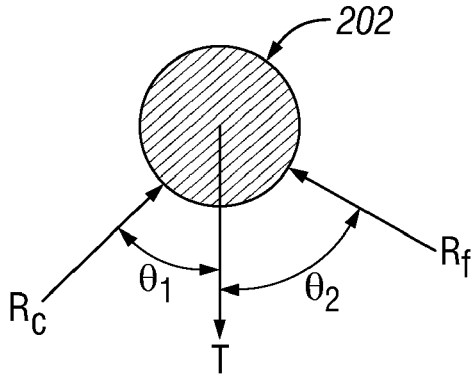
FIG. 9 is a free body diagram of a portion of a cable disposed on the winch drum of FIG. 8.

Note that the cable 202 has been omitted from the drum 700 of FIG. 7 for clarity. However, the cable 202 is included in FIG. 8 which shows an enlarged view of a portion of the drum 700 of FIG. 7. FIG. 9 illustrates the forces acting on an end of one of the cable layers. As shown, when the cable 202 is wound around the drum core 204 and approaches on of the flanges 706, a gap G exists that is not large enough to accommodate another cross section of the cable 202. At this point the layer is complete and a new layer begins. As shown, the portion of the cable 202" that begins the new layer is first pinched and compressed into the gap G. However, this action causes a reaction force $R_c$ from the underlying cable 202 causing the new portion of the cable 202" to be lifted to begin a new layer. This pinching and initial lifting create significant axial load on the flanges 706 as well as compression of the cable 202. By angling the flange 706 with respect to the longitudinal axis 705 of the drum core 704, the reaction force $R_f$ that the flange 706 exerts on the new layer of cable 202" aids in the lifting of the cable 202" and directs the force exerted on it by the cable 202" to a direction that is perpendicular to the contact surface 712 created therebetween rather than primarily axial as would be the case if the inner surface of the flange were perpendicular to the longitudinal axis of the drum core. As a result the bending moment created at the junction 714 between the flanges 706 and the core 704 is reduced, and the life of the drum 700 is likely increased.

FIG. 9 shows a free body diagram of the portion of the cable 202" which begins a new layer. The forces acting on this portion of the cable 202" includes the tension force T acting on the cable 202, the reaction force $R_f$ from the flange 706, and the reaction force $R_c$ from the underlying cable 202.

Figure 10:
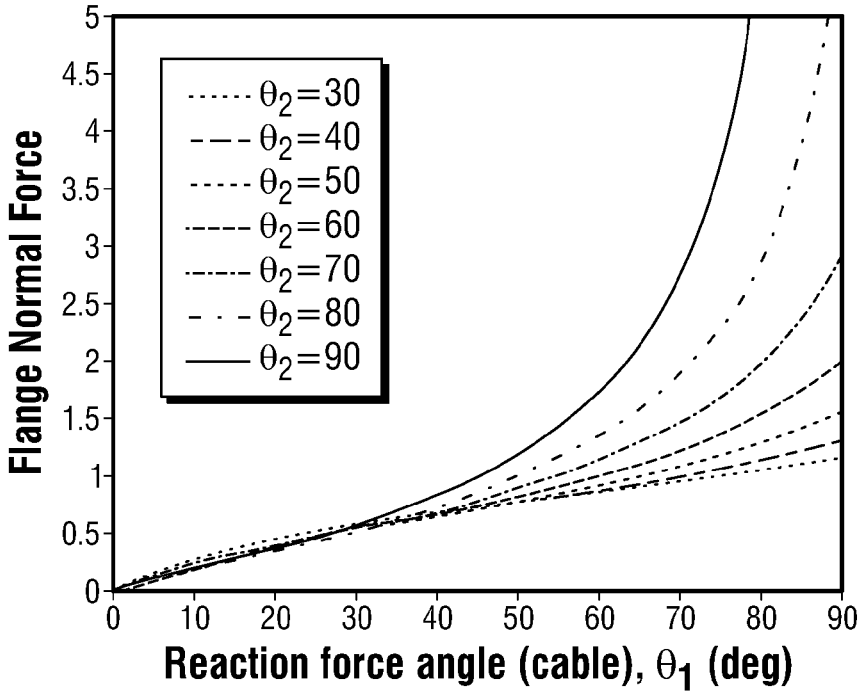
FIG. 10 is graph depicting the forces on a flange of the winch drum of FIG. 7 for various flange angles with respect to a longitudinal axis of the drum.

As such, as shown in FIG. 10 both the angle $\theta_1$ at which the portion of the cable 202" that begins a new layer contacts the underlying cable 202, and the angle $\theta_2$ at which this portion of the cable 202" contacts the flange 706 effects the force that is exerted on the flange 706 from the cable 202". For example, the force on the flange 706 for various flange angles $\theta_2$ is shown in FIG. 10. Note that when $\theta_1$ is 0°, the portion of the cable 202" which begins a new layer is directly on top of its underlying layer. This is not often the case, as the cable will tend to fall into the grooves developed by the underlying layer. Also note that when $\theta_1$ is small, the force on the flange 706 is also small and the force will only be slightly affected and may even increase slightly as $\theta_2$ is varied. But as $\theta_1$ increases, the force on the flange 706 can be dramatically decreases by adjusting $\theta_2$.

Figure 11:
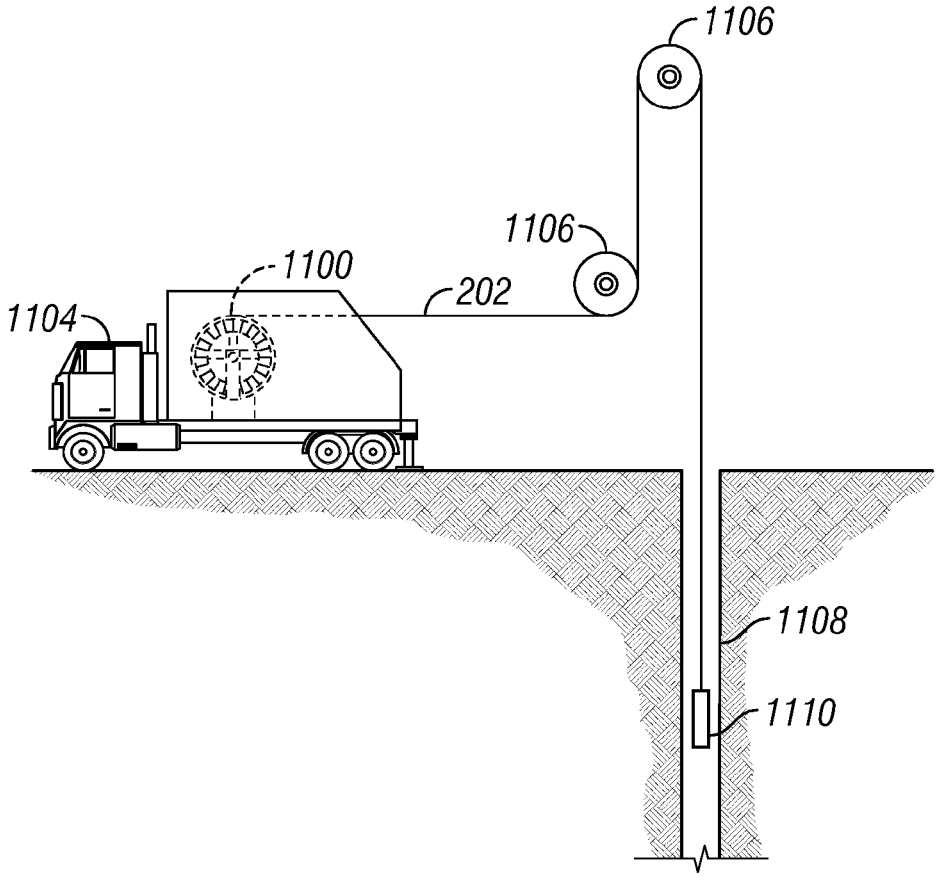
FIG. 11 is a schematic representation of a wireline cable oil field operation using a winch drum according to the present invention.

FIG. 11 shows a winch drum 1100 having a wireline cable 202 spooled thereon and being used in a typical wireline oil well application. Note that winch drum 1100 is meant to represent a generic winch drum which may be replaced by any of the winch drums described above and shown in FIGS. 2-10, such as drums 200, 400, 500, and 700 as well as the winch drum 1400 described below and shown in FIG. 14.

As shown in FIG. 11, a winch drum 1100 is typically brought to a well site on the back of a truck 1104 and stored thereon during an wireline oil well operation. Once on site, the wireline cable 202 is connected to a pair of sheave wheels 1106, which guide the cable 202 from the drum 1100 to a wellbore 1108. An end of the cable 202 is connected to a wireline tool 1110, which may be any appropriate tool for carrying out a wireline oil well operation, such as a logging tool.

Figure 12:
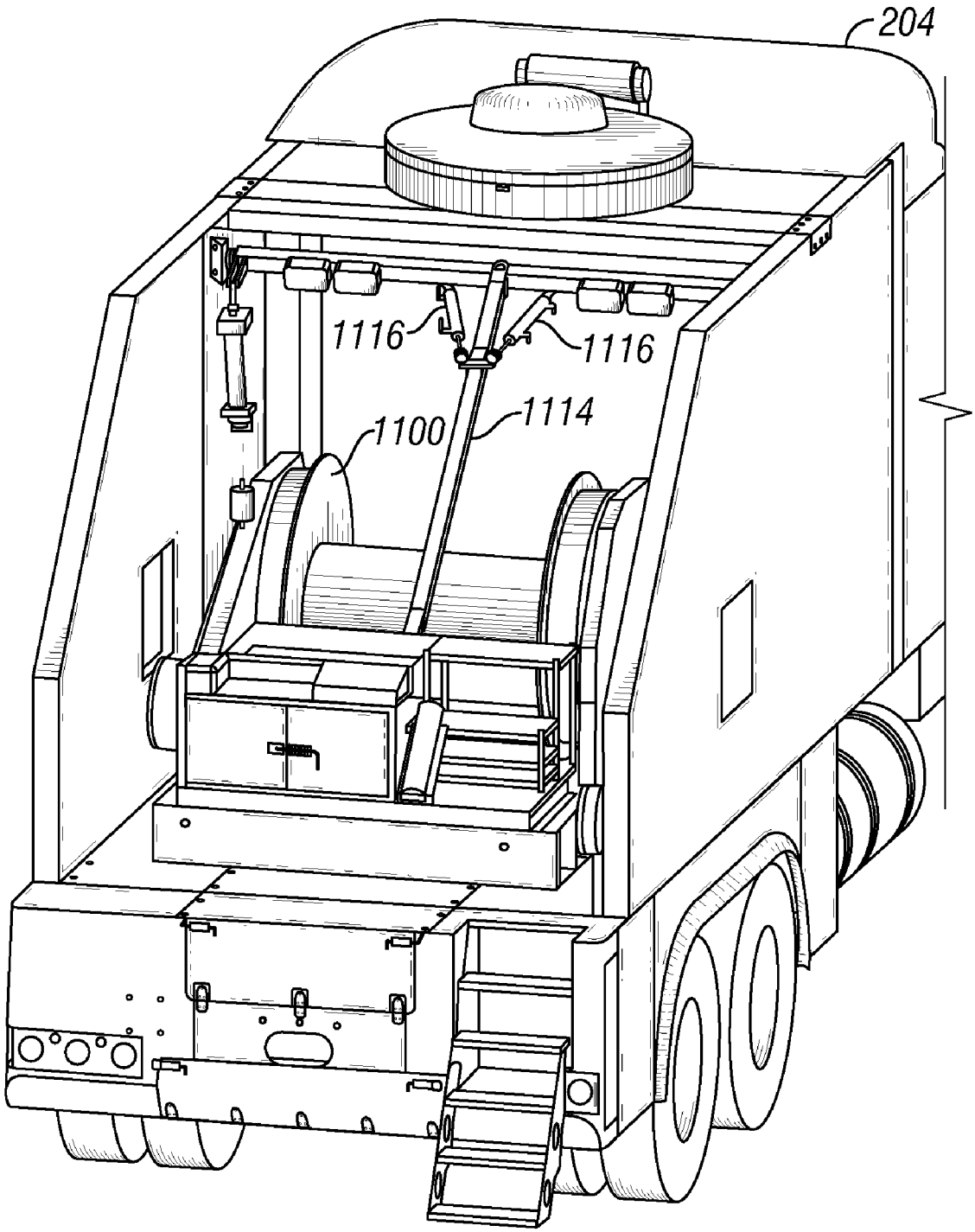
FIG. 12 is a perspective view of a truck shown in FIG. 11.
Figure 13:
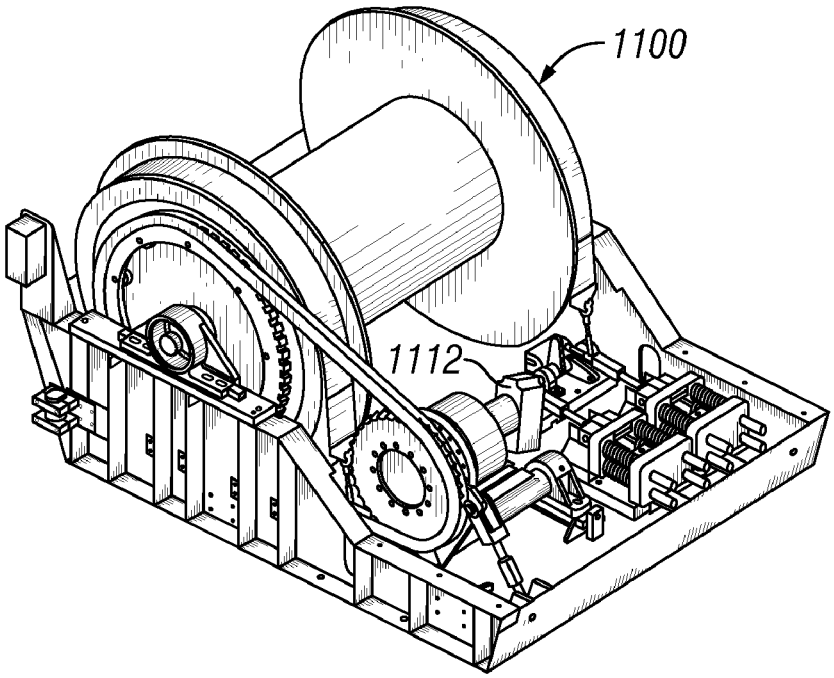
FIG. 13 is a perspective view of a mounting skid for the truck shown in FIG. 12.

As shown in FIGS. 12 and 13, a prime mover, such as a motor 1112, is connected to the winch drum 1100 to effect a rotation of the drum 1100 (note that the wireline cable 202 has been omitted from the drum 1100 in FIGS. 3 and 4 for clarity purposes.) Rotating the drum 1100 causes the cable 202 connected thereto to either spool off of or onto the drum 1100 depending on the direction of rotation of the drum 1100.

As is also shown in FIG. 12, a spooling arm 1114 is connected to the truck 1104 at a position adjacent to the drum 11200. The spooling arm 1114 is connected to the cable 202 to guide the cable 202 when it is spooled onto or off of the drum 1100, but primarily during the spooling of the cable 202 onto the drum 1100 to facilitate a neat wrapping of the cable 202 onto the drum 1100 in order to conserve the available space thereon.

The spooling arm 1114 may be any appropriate device. For example, in the depicted embodiment, the spooling arm 1114 includes one or more hydraulic cylinders 1116 which may be used to effect a lateral movement of the cable 202 relative to the drum 1100, and one or more hydraulic cylinders 1118 (not shown) which may be used to effect a vertical movement of the cable 202 relative to the drum 1100. The spooling arm 1114 may be electrically connected to a control system (not shown) in a cab portion of the truck 1104, and controlled by an operator located therein. Although not shown, the spooling arm 1114 may also include a cable mounted tension device, which is the primary device for measuring the tension in the cable 202. As alluded to above, if the cable mounted tension device fails, then the sensors 420 and 520, in the embodiments of FIGS. 4 and 5 respectively, may be used as backups to also measure the tension in the cable 202.

In order to perform a wireline oil well operation, the drum motor 1112 is rotated in a first direction, which causes the wireline cable 202 to be spooled off of the drum 1100, which in turn causes the wireline tool 1110 connected to the end of the cable 202 to be lowered into the wellbore 1108. As mentioned above, in some applications the wellbore 208 can have a depth of 20,000 feet or more. As such, the cable 202 may correspondingly have a length of 30,000 feet or more so that there is an appropriate amount of excess cable 202. Although the wireline cable 202 may have any appropriate construction, typically the cable 202 includes one or more electrical conductors for sending electronic signals and/or power to the wireline tool 1110. The electrical conductors are typically covered by a strengthening material, such as steel, to prevent the cable from fracturing due to the large tension forces exerted thereon, and an insulation layer for insulating the electrical conductors. Each of these components adds to the weight of the cable 202 and the stresses that the drum 1100 must withstand in situations where the cable 202 is fully stored on the drum, fully extended into the wellbore 1108, and in all positions in between.

Although other sizes of cable 202 may be used, typically the cable 202 has an outside diameter of around ½ inch. For example, common diameters include 0.464 inches and 0.48 inches. However, other appropriate diameter may be used as well. The extreme length of the cable 202 results in relatively high forces exerted in the drum 1100 both during storing of the cable 202 on the drum 1100 and during a wireline oil well operation, where the entire weight of the unspoiled cable 202 plus the weight of the wireline tool 1110 must be supported by the drum 1100. In addition, the extreme length of the cable 202, coupled with its relatively small diameter results in a relatively large number of layers of cable 202 formed on the drum 1100 when the cable 202 is fully stored on the drum 1100. This causes the large stresses on the drum flanges as discussed above. However, various embodiments described above disclose winch drums designed to withstand these forces and have extended lifespans.

Figure 14:
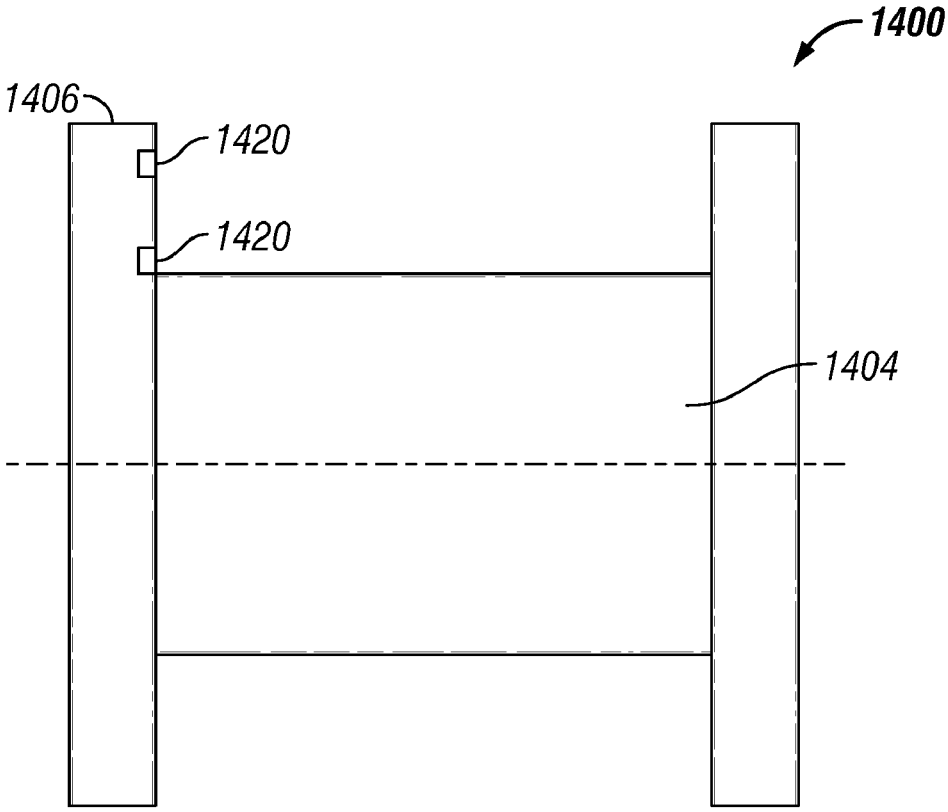
FIG. 14 is a cross sectional view of a winch drum according to yet another embodiment of the present invention.

FIG. 14 shows a winch drum 1400 which may have any of the configurations described above and shown in FIGS. 2-13, such as drums 200, 400, 500, and 700 as well as the winch drum 1400 described below and shown in FIG. 14. As shown in FIG. 14, the winch drum 1400 includes one or more sensors 1420 for measuring any desired physical property of the flange 1406, the core 1404 or any other portion of the drum 1400. For example, the sensors may be used to measure temperature, pressure, stress, strain, or any other desired property. Specifically, in one embodiment one of more of the sensors 1420 are used to measure the stress, stain and/or deformation of the flanges 1406 caused by the interaction between the cable 202 and the flange 1406. Note that although the cable 202 is omitted from FIG. 14 for clarity, the forces between the cable 202 and flanges 1406 are described in detail above.

The measurements taken from the sensors 1420 may be used for any one of a variety of reasons, such as determine when maintenance of the drum 1400 is required and determining the expected lifespan of the drum 1400. In addition, any of the above described measurements may be taken real time and feed to control system (not shown) in a cab portion of the truck 1104, for real time analysis.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A wireline cable winch drum comprising:

a core having a longitudinal axis;

a pair of flanges spaced apart and extending radially outwardly from the core;

a wireline cable wrapped around the core in the space between the flanges; and wherein at least one of the flanges comprises an inner surface that includes a plurality of radially spaced apart protrusions which each form a portion of the inner surface and wherein the inner surface contacts the wireline cable and forms an angle with respect to the longitudinal axis of the core.

2. The drum claim 1, wherein said angle is an acute angle.

3. The drum claim 1, wherein said inner surface forms said angle continuously along a length dimension of its corresponding flange.

4. The drum claim 1, wherein each protrusion comprises a contact surface for contacting a corresponding portion of the cable.

5. The drum claim 4, wherein said contact surface forms said angle with respect to the longitudinal axis of the core.

6. The drum claim 5, wherein said angle is an acute angle.

7. The drum claim 6, wherein said protrusions are each movably attached to its corresponding flange.

8. The drum claim 7, wherein said protrusions are each movable is a direction that is substantially parallel to the longitudinal axis of the core.

9. The drum claim 8, wherein each said protrusion is attached to a biasing member which biases its attached protrusion toward the cable.

10. The drum claim 8, further comprising a sensor connected to at least one of the biasing members for measuring a tension in the cable.

11. A wireline cable winch drum comprising:

a core having a longitudinal axis;

a pair of flanges spaced apart and extending radially outwardly from the core;

a wireline cable wrapped around the core in the space between the flanges; and at least one moving device connected to at least one of the flanges to move its attached flange in a direction parallel to the longitudinal axis of the core to increase or decrease the space on the core between the flanges.

12. The drum claim 11, further comprising at least one sensor connected to at least one of the flanges.

13. The drum claim 12, wherein the at least one sensor measures a stress on its connected flange.

14. The drum claim 13, wherein the at least one moving device moves its connected flange by a predetermined distance which depends on the stress measured by the at least one sensor and a desired reduction in the measured stress.

15. The drum claim 14, wherein the at least one moving device comprises a hydraulic cylinder.

16. The drum claim 11, wherein the at least one moving device comprises one of a hydraulic cylinder, a spring and a screw fastener.

17. The drum claim 11, wherein the at least one moving device comprises a hydraulic cylinder.

18. The drum claim 11, wherein at least one of the flanges comprises an inner surface which forms an angle with respect to the longitudinal axis of the core.

19. The drum claim 18, wherein said angle is an acute angle.

20. A wireline cable winch drum comprising:

a core having a longitudinal axis;

a pair of flanges spaced apart and extending radially outwardly from the core;

a wireline cable wrapped around the core in the space between the flanges; and at least one sensor attached to the drum for measuring a physical property of the drum.

21. The drum claim 20, wherein the at least one sensor measures one of temperature, pressure, stress, strain and deformation.

22. The drum claim 20, wherein the at least one sensor is attached to at least one of the flanges and measures at least one of a stress, a strain and a deformation of at least one of the flanges.

* * * * *